United States Patent [19]

McKann

[11] 4,080,813

[45] Mar. 28, 1978

[54] BOLT LOCK AND LOCKSET ADAPTER ASSEMBLY

[75] Inventor: H. Smith McKann, Fredericksburg, Va.

[73] Assignee: General Products Company Incorporated, Fredericksburg, Va.

[21] Appl. No.: 790,891

[22] Filed: Apr. 26, 1977

[51] Int. Cl.[2] ..... E05B 9/08

[52] U.S. Cl. ..... 70/450; 70/451; 70/461

[58] Field of Search ..... 70/450, 461, 447, 448, 70/451, 449, 370; 292/337

[56] References Cited

U.S. PATENT DOCUMENTS

| | | | |
|---|---|---|---|
| 1,238,924 | 9/1917 | Kennedy | 70/461 |
| 3,479,851 | 11/1969 | Davidson | 70/450 |

*Primary Examiner*—Robert L. Wolfe

*Attorney, Agent, or Firm*—Roylance, Abrams, Berdo & Kaul

[57] ABSTRACT

A mounting plate having three knockouts for three bolt locations of a deadbolt lock is mounted behind a rectangular opening in the edge of a hollow door. A filler plate and a cover plate are provided to cover the unused ones of the knockouts. When no deadbolt lock is installed in the door, the entire filler and cover plates are used to substantially fill the rectangular opening. When a dead bolt is installed in the door, a knockout is removed to leave an opening at the proper location for the bolt to pass through. The deadbolt lock bore drilling is made on the selected centerline either by the distributor or installer. The filler and cover plates are broken along weakened separation lines and appropriate portions thereof are attached to the mounting plate to cover the unused knockout locations. An adjustable backset lockset mounting arrangement is mounted adjacent the rectangular opening to receive and support the lockset in either of two positions. Breakouts in the door are preformed.

11 Claims, 9 Drawing Figures

BOLT LOCK AND LOCKSET ADAPTER ASSEMBLY

This invention relates to installation of lock mechanisms in a hollow door, particularly a metal door, and more specifically to apparatus to permit installation of a selected one or more of a plurality of standard lock types.

BACKGROUND OF THE INVENTION

It is common practice at the present time to provide a door, particularly a door which is provided as an "outside door for a dwelling or other space, with a knob set which may or may not have a lock therein and also with a separate lock of the "deadbolt type. The term "outside as thus used is intended to mean the primary access to a space and can include the main entrance to an apartment or office within a larger structure. With solid wooden doors, the door is commonly manufactured with no lock openings and the carpenter or locksmith who installs the door simply cuts the necessary openings.

However, in the case of hollow doors, particularly hollow metal doors, it is more difficult to accurately and neatly locate and cut the necessary openings to receive a knobset, lockset or lock at the point of installation using conventional hand tools. For this reason, it is desirable to provide such openings at the time of manufacture. It is particularly important to provide a rectangular opening in the door edge to receive a plate having an opening through which the lock bolt is to pass since that opening is the most difficult to locate and cut at the installation site.

However, the manufacturer usually does not know what kind of lock will ultimately be installed in the door. It is well known that deadbolt locks produced by different lock manufacturers have various physical configurations. For example, it is possible that a deadbolt lock may be installed independent of a "standard lockset of the type including a knobset with a lock incorporated therein. It is also possible to install a combination unit including the knob assembly with a lock incorporated therein and a separately lockable deadbolt lock as part of the same assembly. Because of the fact that combination units made by various manufacturers are not standardized completely, the vertical spacing between the knob centerline and the deadbolt centerline can vary. The door manufacturer is therefore faced with the problem of not knowing what kind of plate to provide to fit the rectangular opening and to have a bolt hole which will be at a proper vertical distance from the knob centerline so as to permit passage of the bolt of the lock to be ultimately installed. Even in the case of independently mounted lock and knob devices, it is often desirable to have some flexibility in mounting location. Furthermore, the metal cover plates furnished with the deadbolt locks are provided in different widths and it is desirable to provide some technique for adapting to this variation.

It has previously been proposed to provide a cover plate which is adjustably attachable in the opening. However, this has serious disadvantages. For one, the plate is difficult to position in the rectangular opening with sufficient accuracy such that the deadbolt can reliably and smoothly pass through the opening therein. Additionally, if the adjustability is provided by using elongated openings for the fasteners holding the plate to the door, it is possible for the fasteners to loosen slightly in time, thereby permitting the plate to slip and bind against the bolt, rendering the lock difficult to operate or completely useless.

A further difficulty arises from the fact that the horizontal spacing between the knob centerline and the door edge, referred to as "backset, is nonstandard in the sense that it can be any one of at least two dimensions.

BRIEF DESCRIPTION OF THE INVENTION

It is therefore an object of the present invention to provide a deadbolt preparation structure which can be easily modified at the time of lock installation to accept a deadbolt lock having a bolt in any one of a plurality of locations.

A further object is to provide a bolt aperture plate assembly for a hollow door, particularly a metal door, wherein a rectangular opening is provided in the door at the time of manufacture, the assembly having a mounting plate with a plurality of bolt aperture locations, a filler plate capable of various mountings to match the selected location, and a cover plate which is also capable of various mountings to cover the unselected locations on the mounting and filler plates and to provide thereby an attractive appearance for the door edge with the lock installed.

A further object is to provide a mounting apparatus for a knob lockset assembly adaptable to locksets requiring a plurality of backset dimensions.

Yet another object is to provide a mounting arrangement in a door for receiving lockset and deadbolt structures having a plurality of backset and deadbolt spacing arrangements.

Briefly described, the invention includes an adapter assembly for use in combination with a hollow door of the type having vertical inner and outer panels and an edge panel, the edge panel having a rectangular opening therein to accommodate a lock having a bolt extendable through the edge panel in any one of a plurality of possible vertical locations relative to a horizontal reference plate through said door, the adapter assembly comprising the combination of a mounting plate fixedly attached to said door inwardly of said rectangular opening and substantially parallel with said edge panel, said mounting plate having means defining a plurality of openings, one at each of the possible locations for the bolt; an elongated filler plate having weakened zones along lines extending transversely across said filler plate, said lines defining a plurality of separable filler plate portions one of which includes an opening of substantially the same size as the opening in said mounting plate, said filler plate portions being insertable through said rectangular opening and attachable in contiguous relationship with said mounting plate; and an elongated cover plate insertable through said rectangular opening and attachable in parallel contiguous relationship with said filler plate, said cover plate having weakened zones along lines extending transversely across said cover plate, said lines defining a plurality of separable cover plate portions any combination of which can be attached to said filler and mounting plates to conceal portions thereof not having a selected bolt location.

The invention further includes means in the door edge for passage of a lockset bolt, each of the inner and outer panels including means defining a non-circular opening comprising the area of overlap of two overlapping congruent circles, the centers of which lie at different distances from the edge panel, and arcuate weakened portions defined by the non-overlapping portions of said circles, either of said arcuate portions being removable to complete, with said non-circular opening, a circular opening to receive a lockset having its central axis at a selected one of said different distances.

Further, the invention includes strip metal support means extending between and perpendicular to said inner and outer panels for defining channels to receive the lockset and its bolt, said support means including a curved portion bent to substantially enclose a cylindrical volume shaped like and aligned with the area defined by said overlapping circles, and leg portions extending from said curved portion to said edge panel, said leg portions being fixedly attached to said edge panel and said mounting plate.

BRIEF DESCRIPTION OF THE DRAWINGS

In order than the manner in which the foregoing and other objects are attained in accordance with the invention can be understood in detail, reference is made to the accompanying drawings which form a part of this specification and wherein.

DETAILED DESCRIPTION OF THE DRAWINGS

Figures 1, 3:
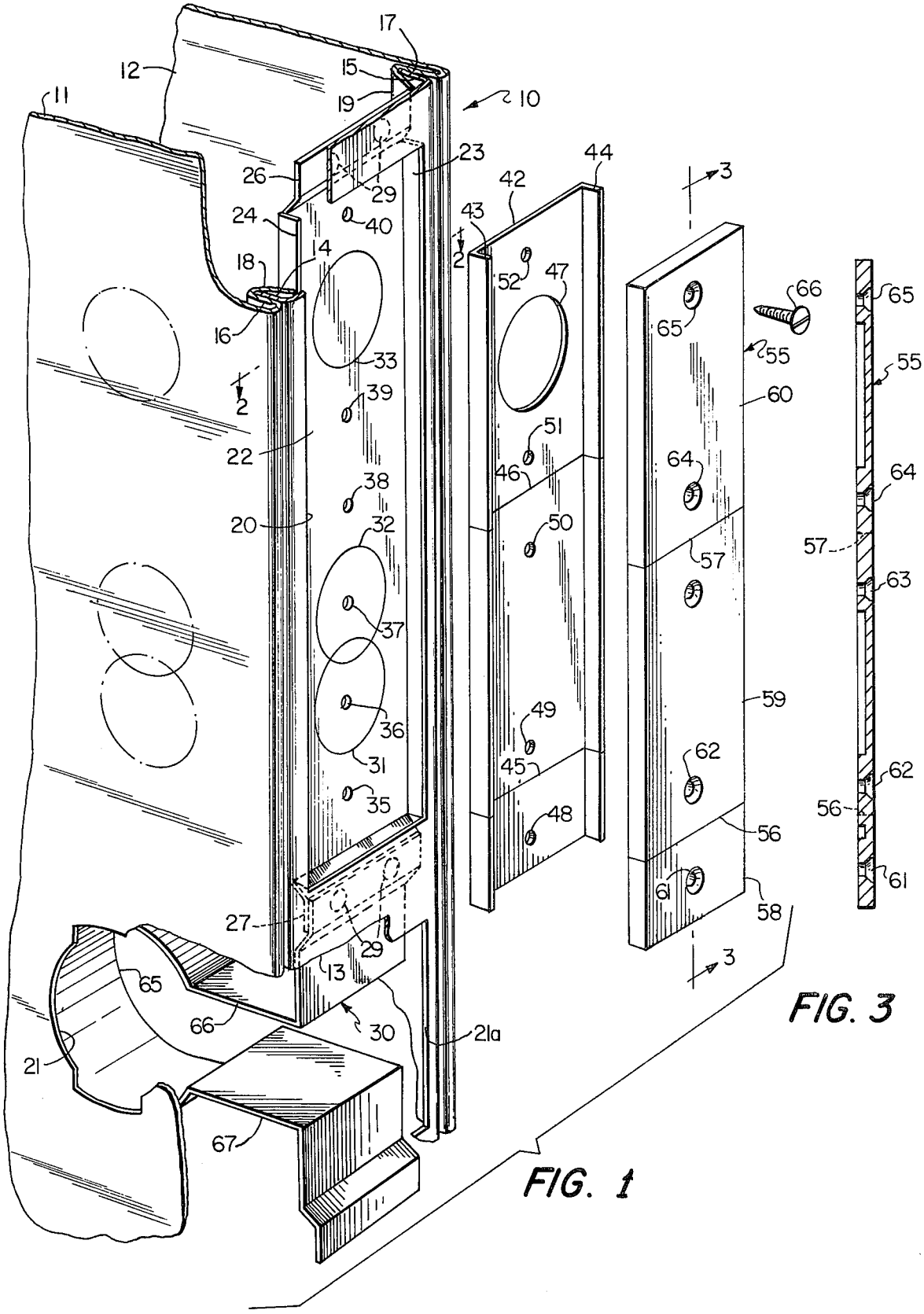
FIG. 1 is a fragmentary perspective exploded view of a portion of a hollow door with an adapter assembly according to the invention.
FIG. 3 is a sectional view of the cover plate along lines 3—3 of FIG. 1.
Figure 2:
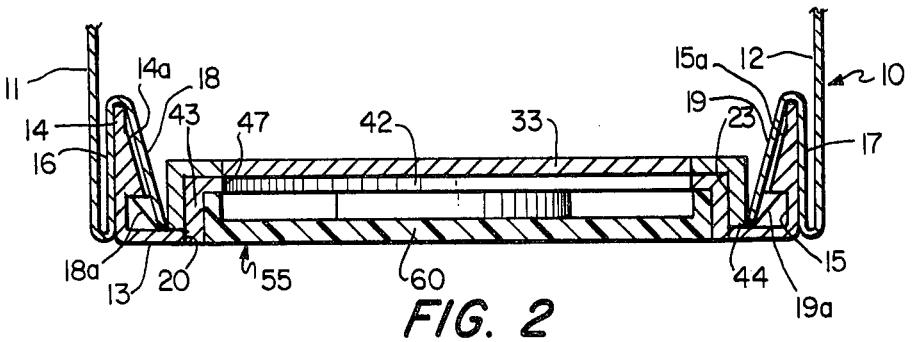
FIG. 2 is a partial assembled sectional view along lines 2—2 of FIG. 1.

As shown in FIG. 1, one possible configuration of a hollow metal door indicated generally at 10 includes front and back metal panels 11 and 12 which are parallel with each other and which constitute the major exposed faces of the door. An elongated edge panel 13 extends perpendicularly between panels 11 and 12 and forms the edge panel for the door which is concealed against the jamb when the door is closed. As seen in FIGS. 1 and 2, the lateral edges of edge panel 13 are bent to form orthogonal flanges 14 and 15 which extend parallel to panels 11 and 12. The edges of panels 11 and 12 are attached to flanges 14 and 15 by bending edge portions thereof backwardly over the panels to provide portions 16 and 17, the edges of these bent portions being bent forwardly again around flanges 14 and 15 with distal edge portions 18 and 19. The inner surfaces of bent flanges 14 and 15 are provided with hook members 14*a* and 15*a*, respectively, which can extend continuously along those flanges. Edge portions 18 and 19 are each provided with a plurality of longitudinally spaced hook members 18*a* and 19*a* which face the opposite direction from hook members 14*a* and 15*a*. Thus, when the edge panel 13 is pressed into the position shown in FIG. 2, the hook members engage each other and securely attach the edge panel to the main door panels.

That is, of course, only one form of door construction which can be used, and is not, in itself, a part of the present invention. The significant factor is that the major panels and the edge panel are provided in the general relationship shown, and are attached to each other at the time of manufacture. Of greater significance is the provision of a rectangular opening 20 through the edge panel, this opening being provided so that a lock can be installed in the door. Panels 11 and 12 are each provided with an opening 21 to receive a knob assembly or lockset, only the opening 21 in panel 11 being shown. Openings in panels 11 and 12 for the deadbolt structure are indicated on the panel by phantom lines. These are normally formed by the installer. Also, a second opening 21*a*, usually rectangular, is provided in edge panel 13 for the tongue or bolt of the lockset. It will be recognized that rectangular opening 20 should be properly located relative to opening 21, its counterpart in panel 11 and opening 21*a* at the time of manufacture so that lock assemblies can be properly located relative to each other. The knob assembly to be installed in opening 21 can incorporate a lock, but need not. In either case, it will be referred to as a "lockset" herein.

At the time of manufacture, an adapter assembly for the deadbolt lock is provided to accompany the door, this assembly including a mounting plate structure which includes a rectangular plate 22, the side edges 23 and 24 of which are bent at right angles to plate 22 to form short flanges which, when installed, abut the inner surface of edge panel 13 and maintain plate 22 in spaced relationship behind opening 20. Top and bottom end mounting tabs 26 and 27 are integrally formed at the upper and lower ends of plate 22 and extend at about a 45° angle forwardly from the ends of the plate and then extend parallel with the plate to provide surfaces which can be spot welded, as indicated at 28 and 29, to the portions of the edge panel immediately above and below opening 20. It will be observed at the bottom of FIG. 1 that tab 27 is attached to the back of an additional member 30 which is provided as a portion of the lockset mounting structure for the knob assembly passing through opening 21, as will be described hereinafter. Member 30 can be welded to the inner surface of the edge panel at the same time the adapter assembly mounting plate is installed.

At the present time, deadbolt locks of a type usable in a door structure such as that shown are produced by major lock manufacturers with bolts which extend from the lock at one of three possible locations relative to the body of the lock. For purposes of discussion herein, a horizontal reference plane will be regarded as passing through the center of opening 21. Thus, for purposes of illustration, the three possible bolt locations have centers which lie at three different distances from that horizontal reference plane. Thus, mounting plate 22 is provided with reseated slugs or knockouts 31, 32 and 33, the centers of which lie in the vertical centerline of the mounting plate and are spaced vertically from the reference plane by these different distances to accommodate the various spacings and also, as previously indicated, to permit flexibility in mounting separate units. These knockouts are formed by punching the sheet metal from which plate 22 is formed with circular dies having incomplete cutting edges so that the slugs are not completely separated from the sheet metal. The slugs are then stamped back into alignment with the remainder of the sheet, thereby forming easily removable closures which can be removed at the time of installation by a sharp blow with a conventional hand tool. It will be observed that knockouts 31 and 32 overlap, this overlapping being necessitated by the fact that the centers thereof are closer together than the diameters of the knockouts, the sizes of the knockouts themselves being determined by the usual bolt size employed in locks of this type. For purposes of illustration, the knockouts are each 1 inch (2.54 cm) in diameter and the centers of the knockouts are spaced from the lower end of opening 20 as follows:

Knockout 31, 1.875 inches (3.02 cm);
Knockout 32, 1.935 inches (4.92 cm);
Knockout 33, 4.3125 inches (10.95 cm).

Also, it should be noted that the rectangular opening 20 is usually about 1 × 5.5 inches (2.54 cm × 13.97 cm), although these dimensions are by no means critical.

Plate 22 also includes mounting holes to receive fasteners such as self-tapping screws, these mounting holes being located along the vertical centerline of the plate and being disposed at distances which are related to the spacing between the knockouts therein. As seen in FIG. 1, there are six such mounting holes identified by reference numerals 35, 36, 37, 38, 39 and 40. These mounting holes are arranged in a specific fashion and are spaced apart to receive the filler and cover plates in various permutations, as will be described. To complete the present example, the following dimensions from the bottom of plate 22 to the centerline of each mounting hole is as follows:

35, 0.375 inches (0.9525 cm);
36, 1.125 inches (2.8575 cm);
37, 2.0 inches (5.088 cm);
38, 2.75 inches (6.985 cm);
39, 3.5 inches (8.89 cm);
40, 5.125 inches (13.0175 cm).

Normally, the lock structure as provided by the manufacturer includes a cover plate, generally metal, with an opening for the bolt. Such plates, however, are provided in two different widths, either 1 or 1⅛ inches. In order to provide a neat tight fit, and to provide a guide opening for the bolt, the adapter assembly includes a filler plate which is an integrally formed structure having a U-shaped cross section with a central main plate portion 42 and flanges 43 and 44 extending along the opposite longer edges thereof. The outside dimension between the outer surfaces of flanges 43 and 44 is slightly less than the distance between the inner surfaces of flanges 23 and 24 so that the filler plate in the form shown in FIG. 1 can be inserted through rectangular opening 20 and be brought into contiguous parallel relationship with plate 22. Flanges 43 and 44 are each about 1/16 inch thick to fill the gaps on the sides of the plate, as discussed.

Filler plate 42 is manufactured in such a way that it can be easily broken into three portions. Thus, the plate is provided with weakening lines 45 and 46, as by a stamping operation. Plate 42 is also provided with an opening 47 which is of the same size as the openings resulting from the removal of closures 31, 32 or 33 in plate 22. Filler plate 42 also includes mounting holes 48, 49, 50, 51 and 52, these holes being spaced along the vertical centerline of the filler plate and longitudinally spaced such that they are alignable with mounting holes 35, 36, 38, 39 and 40 in plate 22. It will be observed that there is no mounting hole alignable with hole 37 when the filler plate is in its assembled unbroken condition. However, it will further be observed that if the filler plate is bent and thereby broken along weakened line 46, the upper portion of the filler plate can be placed adjacent the lower portion of the mounting plate such that hole 51 aligns with hole 35 and hole 52 aligns with hole 37, thereby also aligning opening 47 with the opening resulting from the removal of closure 31. Thus, if the lowermost opening in plate 22 is the selected opening to accommodate a specific lock having a bolt in that location, the filler plate is fractured along line 46 and the upper portion thereof is mounted as described. The remainder of the filler plate can then be inserted through the opening adjacent the upper portion of plate 22 with hole 48 aligned with hole 38 and holes 49 and 50 aligned with holes 39 and 40, respectively. Thus, the three portions of the filler plate can be utilized to cover the entire mounting plate except for the portion occupied by closure 31 which is then removed.

The assembly also includes a cover plate 55 which can be formed of molded plastic or metal, as desired. Cover plate 55 is in the shape of a rectangular parallelepiped and is provided with weakening lines 56 and 57 dividing the cover plate into a lower portion 58, a central portion and an upper portion 60. It will be observed that the three portions of the cover plate are dimensioned to be of equal length to the corresponding portions of the filler plate, and that the width of the cover plate is such that it can be easily placed between the flanges of the filler plate. The cover plate is provided with mounting holes 61–65 which are longitudinally spaced to be alignable with the counterpart portions of the filler plate, the mounting holes in the cover plate being countersunk to receive flathead screws such as screw 66.

As seen in FIG. 3, cover plate 55, when molded using a plastic such as acrylonitrile-butadiene-styrene (ABS) or polyvinylchloride (PVC) forms a simple rectangular structure which can be provided with bosses to strengthen the areas surrounding the mounting screws, as shown by the dotted lines. The exposed surface thereof can be embossed to provide a pleasing appearance.

Figure 4:
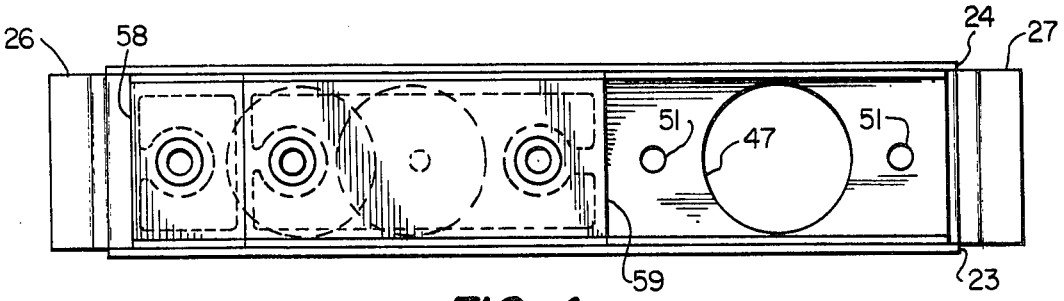
FIGS. 4, 5 and 6 are elevations of the deadbolt adapter assembly with the door omitted showing alternative arrangements of the filler and cover plate portions.
Figure 5:
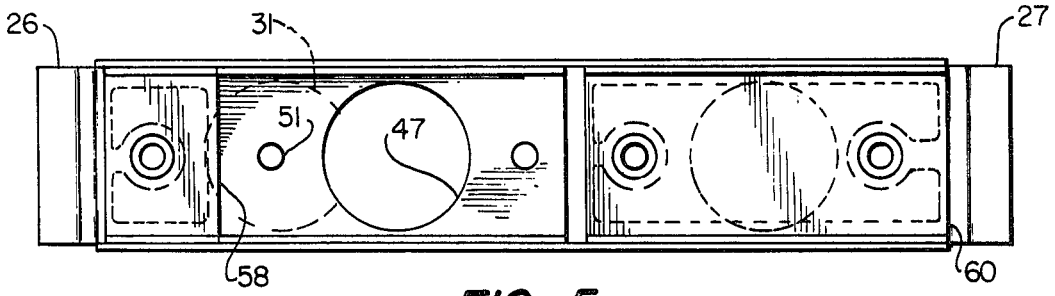
Figure 6:
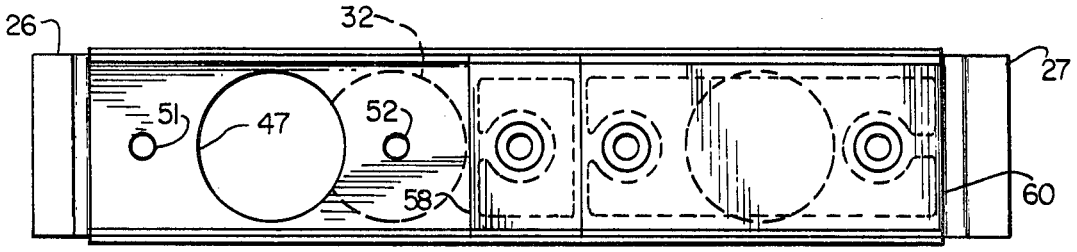

FIGS. 4–6 show the adapter assembly with the door omitted, for simplicity, with the filler and cover plates attached to the mounting plate in three of the possible permutations thereof. As will be recognized, FIGS. 1 and 2 show these structures assembled in the door as they might be when delivered and as they would be when installed without any deadbolt lock at all. FIGS. 4–6 show the structure assembled with the three possible deadbolt locations. Mounting screws have also been omitted for simplicity.

In FIG. 4, it is assumed that the lock is of the type which has a bolt alignable with the opening formed in the mounting plate by the removal of closure 33. Filler plate 42 can therefore be left in its assembled form as shown in FIG. 1 or the upper portion can be removed, depending on the width of the cover plate supplied with the lock, and inserted adjacent the mounting plate with opening 47 aligned with the opening remaining when knockout 33 is removed. The upper portion 60 of cover plate 55 is then removed by bending the structure along the weakening line 57 and is discarded and portions 58 and 59, still assembled, are placed over the lower two portions of the filler plate and the three portions are assembled by inserting screws through holes 61, 62 and 63 and the holes aligned therewith in the filler plate and mounting plate. Thus, the only exposed portion is the upper portion of the filler plate and its bolt opening.

FIG. 5 shows the arrangement of components when the middle one of the openings is employed. In this case, the three portions of the filler plate are separated by bending the plate along lines 45 and 46. The lower, shorter portion of the filler plate is placed nearest the bottom of the assembly, nearest tab 26, and the top portion with its opening 47 is inserted next with the opening aligned with the opening remaining when knockout 32 is removed. The remaining central portion of the filler plate is then placed at the top, covering knockout 33. The lower portion 58 of cover plate 55 is then separated along line 56 from the remaining portions and is placed over the smallest portion of the filler plate and attached thereto with a mounting screw. Portion 60 of the cover plate is then separated from portion 59 and placed at the top of the opening and attached thereto. Clearly, mounting screws are also placed through holes 51 and 52 to attach that portion of the filler plate to the mounting plate. Portion 59 of the cover plate is discarded.

In FIG. 6 is shown the arrangement when the lowermost bolt opening is to be used. In this case, the filler plate is separated along line 46 and the upper portion thereof, if needed, is placed at the bottom with the remainder of the filler plate, still assembled, being placed adjacent the upper portion of the mounting plate. The lower two portions 58 and 59 of the cover plate are separated from portion 60 and are placed over the upper two portions of the cover plate and attached thereto.

As will be recognized, the plates are arranged such that any selected one of the openings can be exposed with the remainder thereof being covered so that the opening is filled to the extent possible and in a manner which presents a pleasing and a finished appearance to the assembled door.

For the sake of completeness, following are the longitudinal dimensions of the portions of the cover plate, these being the same as the corresponding portions of the filler plate:

length of 58, 0.75 inches (1.9 cm);
length of 59, 2.375 inches (6 cm);
length of 60, 2.25 inches (5.7 cm).

The adjustable backset aspect of the invention will be described with reference to FIGS. 1, 7, 8 and 9. As previously indicated a member 30 is attached to the inner surface of edge panel 13. Member 30 comprises a strip of sheet metal bent into a configuration which is more clearly shown in FIG. 7 as viewed from the side opposite that most clearly seen in FIG. 1, that configuration including a generally elliptical portion 65 which is closed at the end farthest from edge panel 13, and open at the end facing panel 13. Straight parallel portions 66 and 67 extend from that open end toward panel 13 but terminate behind panel 13. Mounting flanges 68 and 69 extend outwardly away from each other and parallel to panel 13 to provide a mounting location for a cover plate or filler plate inserted through opening 21*a*. The ends of flanges 68 and 69 can be attached to the inner surface of panel 13 by welding as previously mentioned.

Portion 65, while resembling an ellipse, is more accurately described as the area encompassed by two circles of equal diameter which have their centers spaced apart by a distance somewhat less than a radius of either circle. Thus, the circles overlap and the area of interest includes the areas of both circles plus the area between the circles and upper and lower lines tangent to both circles, i.e., the straight portions at the top and bottom. The circle centers are indicated at 70 and 71.

This generally elliptical portion 65 defines a channel between panels 11 and 12 and serves to maintain the spacing between the panels. A conventional lockset is to be inserted through this channel, but before doing so it is necessary to provide a generally circular opening larger than non-circular opening 21. It will be observed that edge 73 of opening 21 lies on the arc of a circle having its center at 71 and that edge 74 lies on an arc of a circle having its center at 70. The locations of centers 70 and 71 can be selected to be $2\frac{3}{8}$ inches and $2\frac{3}{4}$ inches, respectively, from the outer surface of edge panel 13 because those are two most common backset dimensions.

Figure 7:
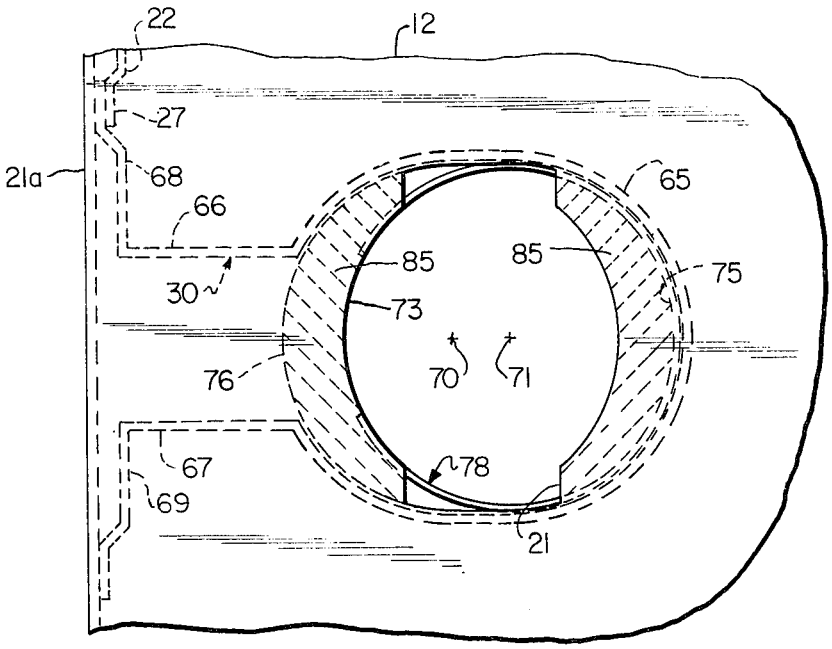
FIG. 7 is a partial side elevation of the door of FIG. 1 showing the lockset adapter.

Thus, to install a lockset having a $2\frac{3}{4}$ inch backset, it is necessary to complete the circular opening centered at 71 and having edge 73 as part of its perimeter. For this purpose, a weakened line is formed in the door along line 75 which, as seen in FIG. 7, describes a circle centered at the same point as the closed end of portion 65 but has a slightly smaller diameter. The weakened line is formed by stamping a groove in the door so that the arcuate portion between edge 74 and line 75 can easily be removed using a hand tool such as pliers.

From this it wil be apparent that if a $2\frac{3}{8}$ inch backset is to be used, the portion between edge 73 and a weakened line 76 is removed, thus completing, with non-circular opening 21, a circular opening centered at 70.

It will be observed that opening 21 includes corners at the top and bottom, and that two of those corners remain after the circular opening has been formed. It has been found that providing the corners when opening 21 is stamped out and the weakened lines are formed eliminates problems of accuracy and tearing at the small somewhat triangular tapered portion which would otherwise remain. The corners are no diadavantage because they are covered by the flash plate provided with the lockset.

Finally, in order to provide firm support around the lockset channel, a generally C-shaped strip metal support member 78 is provided. Member 78 is formed from a resilient metal and has sufficient elasticity so that it can be compressed and inserted through the circular opening formed as described above and then permitted to return substantially to its original size and shape within portion 65. It will be observed that the inner diameter of member 78, as installed, is at least as great as the diameter of the circular opening so that the edges of the door forming that opening contact and are supported by member 78. This is particularly important when the threaded coupling devices in the lockset itself are tightened, thereby subjecting panels 11 and 12 to compressive forces tending to push them toward each other.

Figure 8:
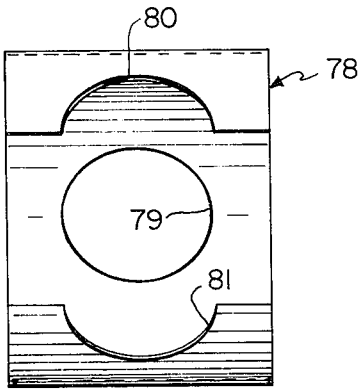
FIGS. 8 and 9 are a plan view and front elevation, respectively, of a support strip member usable in the lockset adapter of FIGS. 1 and 7.
Figure 9:
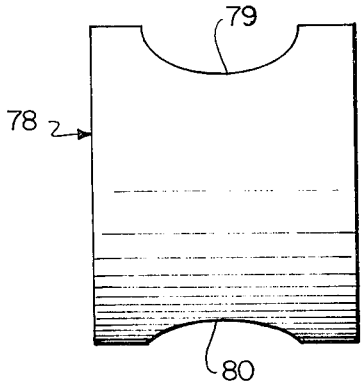

As seen in the front and top views of FIGS. 8 and 9, member 78 has a circular opening 79 and semicircular notches 80 and 81 at the front and back extremes of the member so as to avoid interference with the bolt or tongue mechanism which, in some devices, protrudes through the mechanism of the lockset in both directions.

In order to facilitate removal of one of the arcuate portions to form the circular opening, a plurality of parallel "score" or weakened lines 85 can be provided in addition to lines 75 and 76, thus permitting the arcuate sections to be removed piecemeal and with the application of less force.

While one advantageous embodiment has been chosen to illustrate the invention, it will be understood by those skilled in the art that various changes and modifications can be made therein without departing from the scope of the invention as defined in the appended claims.

What is claimed is:

1. An adapter assembly for use in combination with a hollow door of the type having vertical inner and outer panels and an edge panel, the edge panel having a rectangular opening therein to accommodate a bolt extendable from a lock through the edge panel in any one of a plurality of possible vertical locations relative to a horizontal reference plane through said door, the adapter assembly comprising the combination of a mounting plate fixedly attached to said door inwardly of said rectangular opening and substantially parallel with said edge panel, said mounting plate having means defining a plurality of openings, one at each of the possible locations for the bolt, an elongated filler plate having weakened zones along lines extending transversely across said filler plate, said lines defining a plurality of separable filler plate portions one of which includes an opening of substantially the same size as the openings in said mounting plate, said filler plate being insertable through said rectangular opening and attachable in contiguous relationship with said mounting plate; and an elongated cover plate insertable through said rectangular opening and attachable in parallel contiguous relationship with said filler plate, said cover plate having weakened zones along lines extending transversely across said cover plate, said lines defining a plurality of separable cover plate portions any combination of which can be attached to said filler and mounting plates to conceal portions thereof not having a selected one of the possible bolt locations.

2. An adapter assembly according to claim 1 wherein said mounting plate comprises an elongated rectangular plate having a length and width at least as great as the vertical and horizontal dimensions, respectively, of said rectangular opening;

end tab means fixedly attached to the ends of said plate for attaching said plate to the inner surface of said edge panel above and below said rectangular opening; and side flange means extending toward and abutting said edge panel from said plate for maintaining said plate in parallel spaced relationship with the plane containing said edge panel.

3. An adapter assembly according to claim 2 wherein said mounting plate further includes an easily removable closure in each of said openings.

4. An adapter assembly according to claim 3 wherein said filler plate comprises an elongated rectangular plate having a longitudinal dimension not greater than the vertical dimension of said rectangular opening; and side flanges extending perpendicularly in one direction from said plate to form a body having a generally U-shaped cross section, said filler plate being insertable between said flange means of said mounting plate.

5. An adapter assembly according to claim 4 wherein said cover plate comprises an elongated flat plate insertable through said rectangular opening and between said side flanges of said filler plate.

6. An adapter assembly according to claim 1 wherein said mounting plate includes three removable closures and further includes six holes to receive fastening screws, said filler plate each consists of three separable portions two of said portions each being at least three times as long as the third portion, each of said two portions having two holes to receive mounting screws, the opening in said one portion of said filler plate being in one of said two longer portions.

7. An adapter assembly according to claim 1 wherein said edge panel of said door includes a second opening longitudinally spaced from said rectangular opening to permit passage of a lockset bolt; and wherein each of said inner and outer panels includes means defining a non-circular opening comprising the area of overlap of two overlapping congruent circles, the centers of which lie at different distances from said edge panel, and arcuate weakened portions defined by the non-overlapping portions of said circles, either of said arcuate portions being removable to complete, with said non-circular opening, a circular opening to receive a lockset having its central axis at a selected one of said different distances.

8. An assembly according to claim 7 which further comprises strip metal support means extending between and perpendicular to said inner and outer panels for defining channels to receive the lockset and its bolt, said support means including a curved portion bent to substantially enclose a cylindrical volume shaped like and aligned with the area defined by said overlapping circles, and leg portions extending from said curved portion to said edge panel, said leg portions being fixedly attached to said edge panel and said mounting plate.

9. An assembly according to claim 8 and further comprising a generally C-shaped strip member insertable through said circular opening and into said curved portion of said support means, said strip member being formed or resilient material whereby said member can be diametrally compressed for insertion through said opening and then permitted to expand to its uncompressed shape, the uncompressed inner diameter of said member being at least as great as the diameter of said circular opening.

10. An adapter assembly according to claim 1 wherein two of said openings in said mounting plate overlap, and wherein the lengths of the shortest portions of said filler and cover plates are equal to the distance between the transverse centerlines of said overlapping openings.

11. An adapter assembly for mounting on a hollow door of the type having vertical inner and outer panels and an edge panel, the edge panel having a rectangular opening therein to accommodate a bolt extendable from a lock through the edge panel in any one of a plurality of possible vertical locations relative to a horizontal reference plane through said door, the adapter assembly comprising the combination of a mounting plate fixedly attached to said door inwardly of said rectangular opening and substantially parallel with said edge panel, said mounting plate having means defining a plurality of spaced apart openings, one at each of the possible locations for the bolt;

an elongated cover plate insertable through said rectangular opening and attachable in parallel contiguous relationship with said mounting plate, said cover plate having weakened zones along lines extending transversely across said cover plate, said lines defining a plurality of separable cover plate portions any combination of which can be attached to said mounting plate to conceal portions thereof not having a selected one of the possible bolt locations; and a filler plate insertable through said opening and attachable between said mounting plate and said cover plate, said filler plate having side flanges parallel with said inner and outer panels, said filler plate having weakened zones along lines extending transversely across said filler plate, said lines defining a plurality of separable selectively usable portions.

* * * * *